US007998916B2

(12) United States Patent
Grzyll et al.

(10) Patent No.: US 7,998,916 B2
(45) Date of Patent: Aug. 16, 2011

(54) REPLACEMENT SOLVENTS HAVING IMPROVED PROPERTIES AND METHODS OF USING THE SAME

(75) Inventors: Lawrence R. Grzyll, Merritt Island, FL (US); John A. Meyer, Palm Bay, FL (US); Dwight D. Back, Pembroke Pines, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 448 days.

(21) Appl. No.: 12/192,236

(22) Filed: Aug. 15, 2008

(65) Prior Publication Data

US 2009/0026418 A1 Jan. 29, 2009

Related U.S. Application Data

(62) Division of application No. 11/043,091, filed on Jan. 27, 2005, now Pat. No. 7,429,557.

(51) Int. Cl.
*C11D 7/50* (2006.01)

(52) U.S. Cl. ..... 510/407; 510/408

(58) Field of Classification Search ..... 510/407, 510/408

See application file for complete search history.

(56) References Cited

U.S. PATENT DOCUMENTS

| | | | | |
|---|---|---|---|---|
| 4,999,127 | A | 3/1991 | Merchant | |
| 5,035,828 | A | 7/1991 | Tamura et al. | |
| 5,273,592 | A | 12/1993 | Li | |
| 5,759,430 | A | 6/1998 | Tapscott et al. | |
| 6,010,997 | A * | 1/2000 | Thenappan et al. | 510/410 |
| 6,020,298 | A | 2/2000 | Silvani et al. | |
| 6,048,832 | A | 4/2000 | Thenappan et al. | |
| 6,103,684 | A * | 8/2000 | Thenappan et al. | 510/411 |
| 6,297,308 | B1 | 10/2001 | Jariwaia et al. | |
| 6,300,378 | B1 | 10/2001 | Tapscott | |
| 6,402,857 | B2 | 6/2002 | Clark et al. | |
| 7,067,468 | B2 * | 6/2006 | DeGroot et al. | 510/411 |
| 7,429,557 | B2 * | 9/2008 | Grzyll et al. | 510/407 |
| 7,566,409 | B1 * | 7/2009 | Zastrow et al. | 252/364 |
| 2004/0259752 | A1 * | 12/2004 | DeGroot et al. | 510/415 |
| 2005/0282720 | A1 * | 12/2005 | Itoh et al. | 510/214 |
| 2006/0166851 | A1 * | 7/2006 | Grzyll et al. | 510/407 |

FOREIGN PATENT DOCUMENTS

JP 11-322655 A 11/1999

OTHER PUBLICATIONS

Robert E. Tapscott, J. Douglas Mather "Tropodegradable fluorocarbon replacements for ozone-depleting and global-warming chemicals" Journal of Flourine Chemistry 101 (2000) 209-213.

* cited by examiner

*Primary Examiner* — Gregory E Webb

(57) ABSTRACT

CFC replacement solvent compositions, methods of using the same and methods of making the same. These compositions meet or exceed the solvency, flammability, and compatibility requirements for CFC's while providing similar or improved environmental and toxicological properties. These solvent compositions have applications including, but not limited to, oxygen handling, refrigeration or heat pumps, electronics, implantable prosthetic devices, and optical equipment.

3 Claims, No Drawings

REPLACEMENT SOLVENTS HAVING IMPROVED PROPERTIES AND METHODS OF USING THE SAME

RELATED APPLICATIONS

This application is a divisional application of U.S. application Ser. No. 11/043,091, filed Jan. 27, 2005, the disclosure of which is incorporated by reference herein.

This application is related to "Replacement Solvents Having Improved Properties and Methods of Using the Same" filed on even date, which serial number is Ser. No. 12/192,229.

GOVERNMENT INTEREST

This invention disclosed herein was made with funding from the United States Air Force, pursuant to Contract Number F04611-01-C-0025. The United States Government may have certain rights under this invention.

BACKGROUND OF THE INVENTION

Chlorofluorocarbons (CFC's) are widely used solvents for precision cleaning of parts and components due to their superior physical and chemical properties, especially their solvency for contaminating materials such as oils, greases, resin fluxes, particulates, and other contaminates. One solvent commonly used in many applications is CFC-113(1,1,2-trichloro-1,2,2-trifluoroethane). These solvents are used to clean and/or degrease components or systems related to, but not limited to, oxygen handling systems, refrigeration equipments or heat pumps, electronics, implantable prosthetic devices, and optical equipment. In addition, these solvents have been used as a means to measure residue remaining is a system. For example, in Air Force launch vehicle applications involving liquid or gaseous oxygen systems, CFC-113was the solvent of choice used to detect and quantify the amount of hydrocarbon and fluorocarbon residues in these systems, since the presence of those contaminants can be catastrophic. A further application of these solvents is for foam blowing and polymer coating.

CFC-113has many favorable characteristics such as low toxicity; non-flammability; and stability. Furthermore, CFC-113is not classified as an air-polluting volatile organic compounds (VOC's) by environmental regulators, is practically odorless, and has a high worker exposure threshold value, eliminating the need for costly air circulation or dilution precautions. These benefits also came at a low price (less than 1% of total manufacturing costs in 1988). Coupled with the growth of the electronics industry, and concerns over worker safety due to toxic chemical exposure and hazardous waste disposal resulting from the use of VOC's, the desirable characteristics led to the widespread use of CFC-113.

With the rise of electronic equipment during the 1970s, the need to properly clean these contaminant sensitive parts became very important and the solvent, 1,1,2-trichloro-1,2,2-trifluoroethane (CFC-113), was found to be an excellent and versatile solvent. Being able to dissolve an unusually large array of contaminants (greases, oils, etc) and having excellent physical characteristics, CFC-113became the 'solvent-of-choice' for electronics cleaning and it's use spread to other applications—especially military. Specifically, CFC-113was used to remove solder flux from small spaces between electronic components so as to ensure adhesion of coatings, and prevent corrosion and electromigration of ions. Even more favorable were the non-aggressive properties of CFC-113towards most polymers and coatings and its use permitted a wide use of plastics and other solvent-sensitive materials in the manufacture of electronic components. By 1986, the removal of solder flux from printed circuit board assemblies accounted for close to half of worldwide CFC-113 consumption. A significant portion of the remaining half was utilized by the military and in particular, aviation.

The use of CFC-113, however, is restricted due to the Montreal Protocol due to its ability to react and deplete atmospheric ozone. By the Mid 1980s, problems regarding the ozone became apparent and the primary culprits were certain halogenated hydrocarbons including CFC-113. In 1987, twenty-four nations agreed in principle to control ozone-depleting substances (ODS), such as CFC-113Although this solvent had become critical to the electronics industry, the importance of protecting the earth's ozone layer weighed heavier. Thus, non-toxic and non-ozone depleting replacement solvents became a priority for electronics manufacturers and the military. Various CFC-113substitutes have emerged and often rely on solvents such as n-propyl bromide and dichloroethylene, which are flammable and not as desirable as CFC-113.

Refrigeration systems also require periodic flushing to remove contaminants. A contaminated refrigeration system may have drastically reduced performance resulting from compressor failure, for example. The materials and contaminants in these systems differ from other applications and therefore solvents must be optimized accordingly. For example, a flushing solvent must be compatible with the elastomers and metals in typical systems, while at the same time have the solvency properties to remove oils, acids, and decomposition products of the oils and refrigerants. Some of the currently used flushing solvents include terpenes (e.g., d-limonene), n-propyl bromide, pentafluorobutane, HCFC-141b, and HCFC-225ca/cb.

Selection for CFC replacements typically involves two steps. First, commercially available materials with limited impact on the environment are selected; these are termed next-generation replacements. These next-generation replacements are interim and do not have all the desired properties of an ideal replacement (e.g. they are not as effective solvents or have non-zero ozone depletion potentials, or ODP). The second step is to evaluate the so-called second-generation replacements that are not commercially available, but are only available in research quantities or by custom synthesis, and have properties that are not known. Evaluation and manipulation (e.g. by mixing) of these candidate second generation solvents will result in second generation replacements that meet or exceed the next generation solvents' overall performance since all critical properties required of the solvent are accounted for.

Many factors are important when selecting CFC second-generation replacement solvents. Some of the critical performance properties for a second-generation CFC replacements include: cleaning effectiveness or solvency, volatility (e.g., Boiling point), compatibility with materials to be cleaned (e.g. metals, elastomers and systems), toxicity (e.g., LC50, LD50, cardiac sensitization, mutagenicity, skin irritation), environmental persistence (e.g., ozone depletion potential (ODP), global warming potential (GWP), tropospheric lifetime (TLT), biodegradability), flammability (e.g., autogenous ignition temperature (AIT), flash point), cost and availability.

The solvency of the replacement should be comparable to CFC so the primary factor of performance is not compromised. The volatility and materials compatibility of the replacement solvent should be similar to the CFC so there is minimal impact on existing cleaning systems by switching solvents. Hazardous risks such as flammability, toxicity, and environmental impact are also critical since every manufacturer will be required to eliminate hazardous solvents in the near future.

The solvency performance of the candidate replacements can be quantified through the solubility parameter of the compounds. The hazard potential of the candidate replacements can be characterized using toxicity information such as lethal doses (LD), lethal concentrations (LC) or threshold limit values (TLV), and flammability information. Environmental properties can be analyzed through ozone depletion potential (ODP), global warming potential (GWP), and tropospheric lifetime (TLT). For a discussion of these parameters and their measurements or calculations, see e.g. U.S. Pat. No. 6,300,378, to Tapscott. Volatility can be assessed using the normal boiling point (nBP) of the solvent. If all of these properties and others can be experimentally measured or modeled, one could identify and test non-hazardous "drop-in" replacement solvents to replace hazardous solvents. The following paragraphs discuss the relevance of these performance parameters.

Cleaning Effectiveness or Solvency

The solubility parameter is a very important measure of the cleaning effectiveness of a solvent in dissolving and removing another material. In general, these parameters provide an easy numerical method of rapidly predicting the extent of interaction between materials, particularly liquids. Compounds with similar solubility parameters are known by those skilled in the art to have similar solvency properties. For example, CFC-113has a solubility parameter or about 7.5which is within the range where a solvent will dissolve both hydrocarbon and fluorocarbon greases. This is a fairly unique solubility parameter and is a major part of what makes CFC-113such an excellent solvent. It also makes the substitution for CFC-113rather difficult.

A quantitative method for comparing the relative solubility of different materials is through the use of solubility parameters. This concept of expressing solubility is based on the idea that the solution of one material in another is a spontaneous process, and that it can be stated in terms of the free energy of mixing as shown below:

$$\Delta G=\Delta H+T\Delta S, \tag{1}$$

where ΔG is the free energy of mixing, ΔH is the enthalpy of mixing, and ΔS is the entropy of mixing. The controlling term for a spontaneous process (where ΔG is negative) is the enthalpy of mixing, which can be expressed in terms of $x_1$and $x_2$, the mole fraction of the components, $V_1$and $V_2$, the molar volumes, and $a_1$and $a_2$, the interaction constants.

The expressions for the enthalpy and entropy of mixing are given below:

$$\Delta H_m = \frac{x_1 x_2 V_1 V_2}{x_1 V_1 + x_2 V_2}\left[\frac{\sqrt{a_1}}{V_1} - \frac{\sqrt{a_2}}{V_2}\right]^2 \tag{2}$$

$$\Delta S_m = R[x_1 \ln x_1 + x_2 \ln x_2] \tag{3}$$

The cohesive energy of a mole of a liquid mixture can be stated as $$\Delta E_m = (x_1 V_1 + x_2 V_2)\left[\left(\frac{\Delta E_1^v}{V_1}\right)^{1/2} - \left(\frac{\Delta E_2^v}{V_2}\right)^{1/2}\right]^2 \phi_1\phi_2, \tag{4}$$

where $\Delta E^{\upsilon}$ is the energy of vaporization and $\phi_1$and $\phi_2$are volume fractions. The enthalpy of mixing can be rewritten as $$\Delta H_m = V_T\left[\left(\frac{\Delta E_1^v}{V_1}\right)^{1/2} - \left(\frac{\Delta E_2^v}{V_2}\right)^{1/2}\right]^2 \phi_1\phi_2, \tag{5}$$

where the term $\Delta E^{\upsilon}/V$, the energy of vaporization per unit volume, is a measure of the internal pressure.

This term is called the solubility parameter, δ, and is defined below:

$$\delta = \left(\frac{\Delta E^v}{V}\right)^{1/2} = \left(\frac{\Delta H^v - RT}{V}\right)^{1/2} = \frac{a^{1/2}}{V}, \tag{6}$$

where $\Delta H^{\upsilon}$ is the latent heat of vaporization. (The units of the solubility parameter are typically expressed in $(cal/cm^3)^{1/2}$).

Therefore, the free energy of mixing is given by:

$$\Delta G=V[\delta_1-\delta_2]\phi_1\phi_2+RT[x_1+x_2\ln x_2] \tag{7}$$

and solution should occur as $\delta_1$approaches $\delta_2$

The above expression shows that the solubility parameter of a compound can be calculated directly from the latent heat of vaporization and the molar volume of the compound if these are available. Regardless of the method of determination, solubility parameters are useful in comparing the solvency of compounds because solvents with similar solubility parameters are known by those skilled in the art to have similar solvency properties.

For reference, the solubility parameter in $(cal/cm^3)^{1/2}$for some common compounds are: water, 23.37; acetone, 9.646; ethyl alcohol, 12.779; HFC-134a, 8.067; propane, 6.404; hexane, 7.284; benzene, 9.142; isopropyl alcohol, 11.450; and d-limonene, 8.243.

Volatility

The volatility of a replacement solvent can be described in terms of properties such as the normal boiling point (nBP). An effective solvent replacement must be volatile enough to evaporate, but should not flash off of surfaces since the solvent must reside on the contaminants long enough to dissolve them. An nBP around 40° C. or higher is generally acceptable for cleaning applications.

Compatibility

Material and system compatibility is another requirement for a second-generation solvent. The solvent must be compatible with metals such as aluminum, copper, carbon steel and stainless steel, as well as elastomers. The solvent should not degrade or corrode surfaces in the system being cleaned. The solvent also needs to be compatible with the particular system application. For example, a solvent to be used for cleaning oxygen handling system must be compatible with liquid and gaseous oxygen. In this case, tests such as ASTM G86for ignition sensitivity to mechanical impact must be considered.

Flammability: Autoignition, Flashpoint

Whether a solvent is suitable as cleaning solvents for systems (e.g., oxygen handling systems) is partially dependent upon its flammability, which sometimes is quantified by the autogenous ignition temperatures (AIT). AIT provides a measure of the material's relative ease of ignition and indicates the approximate temperature at which a material could be expected to spontaneously ignite in high-pressure oxygen. This test is typically performed per ASTM Method G72. A rating system has been established by the NASA White Sands Test Facility and Wright-Patterson Air Force Base. By this system, compounds are classified as A (not recommended, AIT<250° F.), B (caution when used, 250° F.<AIT<400° F.), and C (recommended, AIT>400° F.).

Another aspect of the flammability determination is the flashpoint of the solvent. The flashpoint is the temperature at which a liquid gives off vapor sufficient to form an ignitable mixture with air (oxygen) near the surface of the liquid. The ideal replacement solvent should not have a flashpoint below or at its boiling point. This insures a wide range of conditions whereby the solvent can be safely used.

Environmental Persistence

The environmental persistence of a solvent is also very important. Parameters such as the ozone depletion potential (ODP), global warming potential (GWP), and tropospheric lifetime (TLT) are measures of this attribute. ODP and GWP give the relative ability by weight of a chemical to deplete stratospheric ozone and to contribute to global warming, respectively. Values for ODP, GWP and TLT are calculated based on an earth surface release and then reported relative to a reference compound (typically CFC-11or ODP and CFC-11or carbon dioxide for GWP). Generally, the ODP should be less than 0.02, and the GWP and TLT should be minimized, preferably lower than the solvent being replaced.

The biochemical oxygen demand (BOD) is also another measure of persistence typically in groundwater, lakes, and other bodies of water.

Toxicity

Toxicity is yet another factor which must be considered when selecting second-generation replacement solvents. Parameters such as the lethal dose 50 (LD50), lethal concentration 50(LC50), cardiac sensitization, skin irritation, and mutagenicity (e.g., via the Ames test) can be used as measures. LDn or LCn abbreviation, where n is the percent lethality, is used for the dose of a toxicant lethal to n % of a test population. For instance, at LD50, 50% of the recipients of that particular toxic dose would die. Cardiac sensitization is a measure of the ability of a compound to cause cardiac arrhythmia under stress. Generally, it is desired to minimize these parameters and select compounds that have lower values than the solvent that is being replaced.

Review of Prior Art

The CFC-113replacements known in prior art do not address all of the required second-generation solvent properties. CFC-113replacements and solvents that address ozone depletion have been introduced and are disclosed in e.g. U.S. Pat. Nos. 5,035,828, 6,402,857, 6,297,308, and 6,020,298. Various solvents and solvent mixtures are disclosed which have low ODPs. These replacement solvents, however, do not possess all of the desired properties of CFC-113such as flammability, toxicity, oxygen compatibility and cleaning effectiveness.

In U.S. Pat. No. 5,035,828, HCFC-234is combined with an aliphatic alcohol or cyclohexane, but this mixture is easily flammable. U.S. Pat. No. 6,402,857 utilizes n-propyl bromide with other organic constituents, which are also flammable and have a significant adverse impact on ozone. U.S. Pat. No. 6,020,298utilizes hydrofluoropolyethers, and U.S. Pat. No. 6,297,308utilizes halogenated ethers and hydrocarbons with a surfactant. While these solvents appear to avoid damage to the ozone layer, the perfluorinated compounds contained therein are known to be potent greenhouse gases. In addition, perfluorinated and fluorinated (no chlorine) solvents are undesirable as they can have widely varying solubility properties and different interactions with organic residues when compared to CFC-113.

U.S. Pat. No. 6,103,684teaches the use of azeotrope-like mixtures comprised of 1-bromopropane with non-halogenated alcohols and alkanes, as well as halogenated alkanes and fluorinated ethers. The ODP for 1-bromopropane is stated as being between 0.002and 0.03, classifying it as a Class II Ozone Depleting Substance. The flammability limits of 1-bromopropane are 2.7-9.2% in air, with an auto-ignition temperature of 490° C. In addition, the solubility parameter of 1-bromopropane is also 8.839, too high to effectively dissolve many greases and oils. Furthermore, the alcohols and alkanes of this invention are also flammable.

In U.S. Pat. No. 6,048,832, the inventors disclose the use of 1-bromopropane with 4-methoxy-1,1,1,2,2,3,3,4,4-nonafluorobutane (an ether) and at least one other non-halogenated organic compound. As in U.S. Pat. No. 6,103,684, the use of 1-bromopropane is questionable due to its high ODP, flammability, and undesirable solubility parameter. The other components, such as ethanol and 2-propanol, also have high solubility parameters of about 11-13, thereby decreasing the usefulness of these mixtures for a broad spectrum of contaminants as will be taught by the present invention.

Solvents that meet the environmental restrictions and are non-flammable are disclosed in U.S. Pat. Nos. 6,300,378and 5,759,430and in Tapscott & Mather, 2000, Tropodegradable fluorocarbon replacements for ozone-depleting and global-warming chemicals. J. Fluorine Chemistry 101:209-213. Compounds disclosed therein are generally non-flammable and/or non-ozone depleting, as they are "tropodegradable fluorocarbons," defined as compounds having structural weaknesses to ensure rapid decay in the troposphere. When this class of compounds is exposed to sunlight (photolysis) or chemical radicals (e.g. hydroxyls) in the atmosphere, they decay into forms that do not damage the ozone layer nor contribute to the greenhouse effect. The structural weaknesses can take such forms as hydrogen being present on the molecule, a carbon-carbon double bond that is vulnerable to reactions, an ether bond, or a bromine atom being present for easy degradation. These structural vulnerabilities render the molecules unstable, and within a fairly short period of time, they break down and are no longer part of the atmosphere. These references, however, fail to teach solvents with optimized solubility parameters, together with desirable toxicity, and material compatibility. Specifically, these references do not suggest any advantages of using chlorine-containing ethers.

U.S. Pat. No. 5,273,592discloses partially fluorinated ethers having a tertiary structure for solvent cleaning. The benefits of combining partially fluorinated ethers with hydrofluorochloro-ethers (HFCE's) or hydrobromochlorofluoro-alkenes (HBCFA's) for solvent applications are not suggested.

U.S. Pat. No. 4,999,127teaches an azeotropic mixture of $CHF_2$—CClF-O—$CHF_2$, trans-1,2-dichloroethylene, and methanol. Some components of this mixture are toxic and flammable, and hence, not desirable as a safe second generation solvent replacement.

In short, the prior art has taught replacements to CFC's which only partially meet the requirements of a second generation solvent. There is thus a need for second generation replacement solvents that possess all required performance parameters.

SUMMARY OF THE INVENTION

This invention provides second generation solvents that possess all important performance properties, including:

1) Cleaning effectiveness or solvency;
2) Volatility (Boiling point);
3) Compatibility (metals, elastomers, systems);

4) Toxicity (e.g., $LC_{50}$, $LD_{50}$, cardiac sensitization, skin irritation, mutagenicity);
5) Environmental persistence (e.g., Ozone depletion potential (ODP), Global warming potential (GWP), Tropospheric lifetime (TLT), Biodegradability);
6) Flammability (e.g., Autogenous ignition temperature (AIT), Flash point);
7) Cost & availability.

We have discovered that mixtures of certain halogenated compounds can meet or exceed the performance properties of CFC's, and in particular, CFC-113These solvent mixtures comprise two or more compounds selected from hydrofluorochloro-ethers (HFCE's), hydrobromochlorofluoro-alkenes (HBCFA's), hydrofluoro-ethers (HFE's), and halogenated alkanes, alcohols, diones, acetates, ketones (e.g., butanones, pentanones), esters (e.g., propanoates), anhydrides, cycloalkanes (cycloparaffins), cycloalkenes (cycloolefins), heterocyclics (e.g., furans), and aromatics. Many of these compounds have been ignored in the past based on an incomplete evaluation and assumption of generalities pertaining to performance properties. Our approach to identifying these optimal solvent mixtures utilized quantitative structure property relations (QSPR's) and a complex ranking scheme to objectively and completely evaluate numerous potential candidates and numerous properties required to meet the performance of CFC solvents. Many of the compounds and mixtures discovered through this process are novel and have not been considered in the prior art.

The mixtures taught by this invention comprise compounds which are non-flammable as measured by flashpoint and AIT testing, have ODP's of less than about 0.02, and have solubility parameters within about 10% of CFC-113. The boiling points of these components and mixtures are also greater than about 40° C. to make them useful in most solvent applications, with toxicities less than or similar to CFC-113. We have also found that these components and mixtures are compatible with most elastomers and metals.

One object of the present invention is to teach CFC solvent replacements comprising at least two tropodegradable components that act collectively to: meet or exceed the cleaning effectiveness or solvency of the CFC targeted for replacement; have ODP values less than about 0.02; have boiling points greater than about 40° C.; have toxicities less than or similar to the CFC targeted for replacement; have no flash point up to their boiling point; have autogenous ignition temperature classifications of B or C, and be compatible with common elastomers and metals.

The present invention further discloses that certain brominated compounds can be included in solvent mixtures to affect solvency properties so as to perform similar to or better than the CFC targeted for replacement. These brominated compounds are known to offer reductions in flammability, but we have discovered surprisingly that they also offer effective CFC solvency enhancement when combined with other compounds.

It has also been surprising discovered that mixtures of certain compounds can effectively increase the solvency range for certain common contaminants (e.g., hydrocarbon and fluorocarbon greases, oils, decomposition products) when compared to the CFCs targeted for replacement.

In another aspect, this invention shows that compounds that have generally been used as anesthetics are excellent solvents which possess minimal or well-characterized toxicity.

Yet another object of this invention is to teach the use of second generation solvent mixtures to clean and/or degrease components or systems related to, but not limited to, oxygen handling systems, refrigeration systems or heat pumps, electronics, implantable prosthetic devices, and optical equipments.

In a preferred embodiment, solvent mixtures of the present invention are compatible with liquid oxygen handling systems, especially with regard to ignition sensitivity to mechanical impact in liquid oxygen.

A related object of this invention is to teach alternative CFC compositions suitable for foam blowing and applying coatings.

An additional object of this invention is to teach the general methods by which second generation solvents can be specified to replace not only CFC's, but also future compounds which will be banned from use such as hydrochlorofluorocarbons (HCFC's) and hydrobromofluorocarbons (HBFC's).

BRIEF DESCRIPTION OF TABLES 1AND 2

Table 1lists compounds derived using the methods of the present invention. Compounds listed therein have boiling points greater than 40° C., ODP values less than about 0.02, a solubility parameter within a range of about +10% of CFC-113, a CS value greater than or equal to 80% of the CFC-113value, and TLT's less than that of CFC-113. In Table 1, $CS/CS_{113}$refers to cardiac sensitization (CS), a measure of inhalation toxicity of the compound relative to CFC-113with a predicted value of 1090ppm; and SP is the solubility parameter. The values for this selected group of solvent properties are shown with CFC-113as reference. Five more preferred compounds of this invention are denoted by the letters A though E in the table. The underlined numbers in Table 1are experimental values. Others are predictions from quantitative structure property relations (QSPR's, see below), illustrating the necessity of using QSPR's as taught by this invention to compare and evaluate a large list of second-generation candidates.

Table 2summarizes some of the preferred compounds, and their boiling points and solubility parameters relative to CFC-113.

DETAILED DESCRIPTION OF THE INVENTION

The solvent CFC-113(1,1,2-trichloro-1,2,2-trifluoroethane) had been the solvent of choice for many applications until the mid-1980's. Due to its phase out, alternative solvents with similar overall properties have been sought. Those skilled in the art have attempted to find replacements with some success, believing that because CFC-113possess so many desirable properties that must be matched, a replacement solvent must sacrifice or comprise on some performance properties.

Using a novel and heretofore never suggested approach, the inventors of the present invention first developed a comprehensive list of candidate replacements meeting key performance properties, and then tested these individual components as replacements. This approach is completely objective and unbiased by previously untested assumptions or generalities related to certain classes of compounds.

As a consequence, the inventors of the present invention discovered, as have others, that a single component replacement cannot meet all of the performance requirements of most first generation solvents, most notably, solvency. Our focus then turned to mixtures of compounds which possessed a difference in solubility parameter in order to increase the solubility range for the second generation solvent. It is by this process that we discovered certain synergies when combining these solvents. The general process by which we made this discovery is described below.

We considered a total of about 800compounds. The compounds included halogenated alcohols, halogenated alkenes, halogenated amines, halogenated aromatics, halogenated carbonyls, halogenated ethers, halogenated alkanes, halogenated heterocyclics, halogenated cycloalkanes (cycloparaffins), and halogenated cycloalkenes (cycloolefins). The list of potential second-generation CFC solvent replacements was then mathematically analyzed to arrive at a list of compounds which simultaneously met the performance requirements for solvency, boiling point, and toxicity for a second-generation replacement to CFC-113. A mathematical database of properties critical to solvent function was tabulated with this large list of potential second generation solvents. If literature or experimental values for the performance properties were not available, we developed quantitative structure property relations (QSPR's) to model and predict the particular property which was then included in the database table. Those skilled in the art will understand the usefulness and accuracy of QSPR's in the development of products such as environmentally-friendly chemicals and pharmaceuticals. This overall method of objectively selecting compounds by considering a large number of constraining performance properties can be used for a variety of applications whereby target properties of the first generation solvent are known.

As stated previously, there are several critical performance properties which must be considered when prescribing solvent replacements. These properties include:

1) Cleaning effectiveness or solvency;
2) Volatility (Boiling point);
3) Compatibility (metals, elastomers, systems);
4) Toxicity (e.g., LC50, LD50, cardiac sensitization, skin irritation, mutagenicity);
5) Environmental persistence (e.g., Ozone depletion potential (ODP), Global warming potential (GWP), Tropospheric lifetime (TLT), Biodegradability);
6) Flammability (e.g., Autogenous ignition temperature (AIT), Flash point); and
7) Cost & availability.

Of the properties listed above, those having primary significance in selecting a second generation replacement are the solvency, volatility, toxicity, and environmental persistence. More specifically, an acceptable second generation solvent should generally have boiling points greater than about 40° C., ODP values less than about 0.02, high LD50values greater than about 5g/kg, and solubility parameters within about 10% of CFC-113. Other toxicity measures (e.g., cardiac sensitization or CS, mutagenicity, skin irritation, and inhalation LC50) should be minimized with respect to the compounds targeted for replacement. The remaining properties of compatibility and flammability are also important, and were measured for several compounds meeting the solvency, volatility, toxicity, and environmental persistence requirements. Table 1shows a summary of numerous compounds resulting from the process described above which met these important performance properties. The values in underlined are experimental data, whereas the other values are QSPR model predictions. CFC-113properties are shown on line 1of Table 1for comparison.

TABLE 1

| CHEMICAL NAME | BP (C.) | GWP | ODP | T.L.T. (yrs.) | $CS/CS_{113}$ | SP $(cal/cm^3)^{1/2}$ |
|---|---|---|---|---|---|---|
| 1,1,2-trichlorotrifluoroethane (CFC-113) (Comparative) | 47.6 | 5000 | 0.90 | 85 | 1.0 | 7.19 |
| (A.) 4-bromo-3-chloro-3,4,4-trifluoro-1-butene | 99.7 | 0 | 0.01 | 0.01 | 0.8 | 7.76 |
| (B.) 1-chloro-2,2,2-trifluoroethyl difluoromethyl ether (isoflurane) | 48.8 | 200 | 0.02 | 4.0 | 50.2 | 7.58 |
| (C.) 2-chloro-1,1,2-trifluoroethyl difluoromethyl ether (enflurane) | 56.7 | 330 | 0.02 | 5.3 | 35.5 | 7.71 |
| (D.) 1-bromo-2-(trifluoromethyl)-3,3,3-trifluoropropene | 49.3 | 2281 | 0.01 | N/A | 49.4 | 6.95 |
| (E.) methyl 2,2,2-trifluroethyl-1-(trifluoromethyl)ether | 50.8 | 28 | 0.00 | 0.18 | 107.3 | 7.26 |
| 4-bromo-1,1,1,3,4,4-hexafluoro-2-(trifluoromethyl)-2-butene | 68.1 | 9849 | 0.01 | 0.44 | 103.2 | 6.51 |
| heptafluoropropyl 1,2,2,2-tetrafluoroethyl ether | 41.0 | 597 | 0.00 | 4.5 | 195.7 | 6.62 |
| perfluorodibutyl ether | 110.1 | 33 | 0.00 | 1.2 | 896.2 | 6.65 |
| 4-bromo-1,1,1,4,4-pentafluoro-2-(trifluoromethyl)-2-butene | 61.0 | 7572 | 0.01 | 0.30 | 105.5 | 6.74 |
| methyl perfluorobutyl ether | 51.0 | 480 | 0.00 | 3.5 | 53.5 | 6.75 |
| 3-bromo-1,1,2,3,4,4,4-heptafluorobutene | 47.5 | 422 | 0.01 | 0.62 | 21.9 | 6.75 |
| 1,1,1,4,4-pentafluoro-4-bromo-2-trifluoromethyl-2-butene | 61.0 | 7572 | 0.01 | 0.30 | 105.5 | 6.77 |
| 1-bromo-1,3,3,3-tetrafluoro-2-(trifluoromethyl)-1-propene | 51.9 | 5061 | 0.01 | 0.62 | 71.9 | 6.78 |
| (Z)-1-bromo-perfluoro-2-butene | 48.0 | 2540 | 0.01 | 0.62 | 41.4 | 6.78 |
| 4-bromo-1,1,2,3,3,4,4-heptafluorobutene | 51.5 | 422 | 0.01 | 0.62 | 23.4 | 6.78 |
| (Z)-2-bromo-1,1,1,3,4,4,4-heptafluoro-2-butene | 49.0 | 2540 | 0.01 | 0.62 | 48.6 | 6.79 |
| 3,3,3-trifluoro-bis-2,2-(trifluoromethyl)-1-propanol | 86.1 | 1201 | 0.00 | 3.5 | 40.7 | 6.81 |
| 1,2-(Z)-bis(perfluoro-n-butyl)ethylene | 132.0 | 15 | 0.00 | 0.03 | 1188.5 | 6.81 |
| (E)-2-bromo-1,1,1,3,4,4,4-heptafluoro-2-butene | 49.0 | 2540 | 0.01 | 0.62 | 48.6 | 6.82 |

TABLE 1-continued

| CHEMICAL NAME | BP (C.) | GWP | ODP | T.L.T. (yrs.) | $CS/CS_{113}$ | SP $(cal/cm^3)^{1/2}$ |
|---|---|---|---|---|---|---|
| 1,1,1,3,3,3-hexafluoro-2-(trifluoromethyl)-2-propanol | 46.0 | 1292 | 0.00 | 13.1 | 61.2 | 6.84 |
| 2H,3H-decafluoropentane (Vertrel XF) | 55.0 | 1300 | 0.00 | 26.8 | 91.5 | 6.84 |
| ethyl-perfluorobutyl ether | 73.0 | 70 | 0.00 | 1.14 | 69.0 | 6.85 |
| (E)-1-bromo-perfluoro-2-butene | 48.0 | 2540 | 0.01 | 0.62 | 41.4 | 6.85 |
| 1,1,1,5,5,5-hexafluoro-2,4-pentanedione | 69.9 | 97 | 0.00 | 0.00 | 140.5 | 6.90 |
| perfluoro-2-butyltetrahydrofuran | 103.0 | 13 | 0.00 | 2.4 | 65.4 | 6.94 |
| 1H,2H,4H-nonafluorocyclohexane | 65.0 | 252 | 0.00 | 6.19 | 18.5 | 7.02 |
| (E)-2-bromo-1,1,1,4,4,4-hexafluoro-2-butene | 45.1 | 1565 | 0.01 | 0.38 | 42.7 | 7.06 |
| 1-bromo-bis(perfluoromethyl) ethylene | 45.1 | 1565 | 0.01 | 0.38 | 42.7 | 7.06 |
| 1-(bromodifluoromethoxy)-2-(trifluoromethyl)-1,3,3,3-tetrafluoro-1-propene | 78.6 | 6104 | 0.01 | 0.11 | 187.0 | 7.06 |
| 1-methoxy-2-trifluoromethyl-1,3,3,3-tetrafluoro-1-propene | 44.5 | 933 | 0.00 | 0.07 | 154.6 | 7.09 |
| fluoromethyl 2,2,2-trifluoro-1-(trifluoromethyl)ethyl ether (SEVOFLURANE) | 59.0 | 1586 | 0.00 | 2.3 | 103.0 | 7.10 |
| (E)-2,3-dichlorohexafluoro-2-butene | 68.5 | 1104 | 0.00 | 0.32 | 72.4 | 7.15 |
| 2-bromo-3,3,4,4,4-pentafluorobutene | 66.1 | 84 | 0.01 | 0.32 | 10.5 | 7.19 |
| 3-bromo-2,3,4,4,4-pentafluorobutene | 69.7 | 84 | 0.01 | 0.32 | 4.9 | 7.20 |
| 4-bromo-2,3,3,4,4-pentafluorobutene | 69.2 | 84 | 0.01 | 0.32 | 6.0 | 7.21 |
| (Z)-1-(bromodifluoromethoxy)-1,2,3,3,3-pentafluoro-1-propene | 65.2 | 1334 | 0.01 | 0.14 | 70.1 | 7.22 |
| 3-bromo-3,3-difluoro-2-(trifluoromethyl)-propene | 49.7 | 733 | 0.01 | 0.32 | 15.0 | 7.24 |
| (Z)-1-bromo-1,1,4,4,4-pentafluoro-2-butene | 40.0 | 620 | 0.02 | 0.23 | 36.6 | 7.25 |
| (E)-1-(bromodifluoromethoxy)-1,2,3,3,3-pentafluoro-1-propene | 65.2 | 1334 | 0.01 | 0.14 | 70.1 | 7.25 |
| 3,3-dichloro-1,1,1,2,2-pentafluoropropane (HCFC-225) | 48.5 | 237 | 0.02 | 12.7 | 16.7 | 7.26 |
| 1-(bromodifluoromethoxy)-2-(trifluoromethyl)-3,3,3-trifluoro-1-propene | 78.3 | 2729 | 0.01 | 0.08 | 151.6 | 7.26 |
| methyl-1,1,2,2,3,3-hexafluoropropyl ether | 40.1 | 99 | 0.00 | 2.34 | 36.5 | 7.27 |
| trifluoroacetic anhydride | 40.2 | 97 | 0.00 | 0.00 | 236.9 | 7.29 |
| 2-bromo-1,1,2,2-tetrafluoroethoxy-trifluoroethene | 81.9 | 137 | 0.01 | 0.14 | 33.0 | 7.30 |
| 2,2-difluoroethyl-1,1,2,2-tetrafluoroethyl ether | 48.4 | 152 | 0.00 | 0.92 | 114.6 | 7.31 |
| 1,3-dichloro-1,1,2,2,3-pentafluoropropane (HCFC-225cb, AK-225G) | 52.7 | 350 | 0.02 | 6.6 | 9.2 | 7.31 |
| bis(2,2,2-trifluoroethyl)ether | 62.5 | 477 | 0.00 | 1.5 | 109.2 | 7.32 |
| methyl heptafluoropropyl ketone | 63.5 | 34 | 0.00 | 0.13 | 25.4 | 7.32 |
| (E)-1-bromo-1,1,4,4,4-pentafluoro-2-butene | 40.0 | 620 | 0.02 | 0.23 | 36.6 | 7.37 |
| difluoromethyl-2,2,3,3-tetrafluoropropyl ether | 49.8 | 152 | 0.00 | 0.92 | 109.9 | 7.44 |
| 4-bromo-3,3,4,4-tetrafluoro-1-butene | 55.0 | 69 | 0.01 | 0.20 | 5.8 | 7.44 |
| bis(difluoromethoxy)-tetrafluoroethane | 58.0 | 172 | 0.00 | 0.86 | 362.3 | 7.50 |
| 2-chloro-1,1,2-trifluoroethyl ethyl ether | 88.9 | 31 | 0.00 | 0.41 | 15.0 | 7.50 |
| 1-(2,2,2-trifluoroethoxy)nonafluoro-cyclohexene | 113.7 | 112 | 0.00 | 0.05 | 70.2 | 7.51 |
| 1,2-dichloro-3,3,4,4,5,5,6,6-octafluoro-cyclohexene | 123.8 | 30 | 0.00 | 0.27 | 15.5 | 7.55 |
| (Z)-1-bromo-1,2-difluoro-2-(2,2,2-trifluoroethoxy)-ethene | 87.9 | 138 | 0.00 | 0.04 | 52.7 | 7.61 |
| (bromodifluoromethyl)-pentafluorobenzene | 153.3 | 199 | 0.00 | 0.82 | 28.2 | 7.63 |
| (Z)-1-(bromodifluoromethoxy)-2-(trifluoromethyl)ethene | 57.8 | 238 | 0.02 | 0.06 | 54.3 | 7.63 |

TABLE 1-continued

| CHEMICAL NAME | BP (C.) | GWP | ODP | T.L.T. (yrs.) | $CS/CS_{113}$ | SP $(cal/cm^3)^{1/2}$ |
|---|---|---|---|---|---|---|
| 2-bromoheptafluorotoluene | 151.3 | 199 | 0.00 | 0.82 | 21.5 | 7.64 |
| (2,2,2-trifluoroethyl)(2-bromo-2,2-difluoroethyl)ether | 73.0 | 238 | 0.02 | 0.96 | 52.1 | 7.64 |
| 3-bromoheptafluorotoluene | 153.0 | 199 | 0.00 | 0.82 | 21.1 | 7.66 |
| 4-bromoheptafluorotoluene | 151.3 | 199 | 0.00 | 0.82 | 37.9 | 7.66 |
| 1-(bromodifluoromethoxy)-1-(trifluoromethyl)ethene | 66.3 | 340 | 0.01 | 0.10 | 27.7 | 7.67 |
| ethyl-1,1,2,2-tetrafluoroethyl ether | 45.9 | 61 | 0.00 | 0.66 | 38.5 | 7.67 |
| Perfluorotoluene | 104.0 | 335 | 0.00 | 1.1 | 64.0 | 7.70 |
| (E)-1-(bromodifluoromethoxy)-2-(trifluoromethyl)ethene | 57.8 | 238 | 0.02 | 0.06 | 54.3 | 7.73 |
| 1-bromo-2,4,6-tris(trifluoromethyl)benzene | 173.4 | 618 | 0.00 | 0.34 | 113.0 | 7.76 |
| methyl pentafluoropropanoate | 59.5 | 30 | 0.00 | 0.05 | 27.0 | 7.77 |
| 4-bromo-1,1,2,3,3-pentafluorobutene | 80.4 | 314 | 0.00 | 0.15 | 25.3 | 7.79 |
| (E)-1-(bromodifluoromethoxy)-2-(trifluoromethoxy)ethene | 76.5 | 682 | 0.02 | 0.04 | 144.9 | 7.79 |
| (Z)-1-(bromodifluoromethoxy)-2-(trifluoromethoxy)ethene | 76.5 | 682 | 0.02 | 0.04 | 144.9 | 7.79 |
| 1,1,4,4,4-pentafluoro-1-bromo-2-butanone | 89.0 | 340 | 0.01 | 0.09 | 17.1 | 7.89 |
| 1,1,5,5,5-pentafluoro-1-bromo-3-pentanone | 118.4 | 197 | 0.00 | 0.03 | 34.2 | 7.89 |
| 1,2-dichloro-hexafluoro-cyclopentene | 90.0 | 45 | 0.00 | 0.34 | 9.9 | 7.90 |
| 3-bromo-2,3,3-trifluoropropene | 41.6 | 101 | 0.02 | 0.26 | 6.1 | 7.66 |
| 3-bromo-1,3,3-trifluoropropene | 41.5 | 153 | 0.02 | 0.17 | 12.9 | 7.73 |
| 3-bromo-3,3-difluoro-1-propene | 42.0 | 66 | 0.02 | 0.13 | 5.9 | 7.89 |

Table 1A

Bromo-containing compounds of Table 1

| | | | | | | |
|---|---|---|---|---|---|---|
| 1,1,2-trichlorotrifluoroethane (CFC-113) (Comparative) | 47.6 | 5000 | 0.90 | 85 | 1.0 | 7.19 |
| (A.) 4-bromo-3-chloro-3,4,4-trifluoro-1-butene | 99.7 | 0 | 0.01 | 0.01 | 0.8 | 7.76 |
| (D.) 1-bromo-2-(trifluoromethyl)-3,3,3-trifluoropropene | 49.3 | 2281 | 0.01 | N/A | 49.4 | 6.95 |
| 4-bromo-1,1,1,3,4,4-hexafluoro-2-(trifluoromethyl)-2-butene | 68.1 | 9849 | 0.01 | 0.44 | 103.2 | 6.51 |
| 4-bromo-1,1,1,4,4-pentafluoro-2-(trifluoromethyl)-2-butene | 61.0 | 7572 | 0.01 | 0.30 | 105.5 | 6.74 |
| 3-bromo-1,1,2,3,4,4,4-heptafluorobutene | 47.5 | 422 | 0.01 | 0.62 | 21.9 | 6.75 |
| 1,1,1,4,4-pentafluoro-4-bromo-2-trifluoromethyl-2-butene | 61.0 | 7572 | 0.01 | 0.30 | 105.5 | 6.77 |
| 1-bromo-1,3,3,3-tetrafluoro-2-(trifluoromethyl)-1-propene | 51.9 | 5061 | 0.01 | 0.62 | 71.9 | 6.78 |
| (Z)-1-bromo-perfluoro-2-butene | 48.0 | 2540 | 0.01 | 0.62 | 41.4 | 6.78 |
| 4-bromo-1,1,2,3,3,4,4-heptafluorobutene | 51.5 | 422 | 0.01 | 0.62 | 23.4 | 6.78 |
| (Z)-2-bromo-1,1,1,3,4,4,4-heptafluoro-2-butene | 49.0 | 2540 | 0.01 | 0.62 | 48.6 | 6.79 |
| (E)-2-bromo-1,1,1,3,4,4,4-heptafluoro-2-butene | 49.0 | 2540 | 0.01 | 0.62 | 48.6 | 6.82 |
| (E)-1-bromo-perfluoro-2-butene | 48.0 | 2540 | 0.01 | 0.62 | 41.4 | 6.85 |
| (E)-2-bromo-1,1,1,4,4,4-hexafluoro-2-butene | 45.1 | 1565 | 0.01 | 0.38 | 42.7 | 7.06 |
| 1-bromo-bis(perfluoromethyl) ethylene | 45.1 | 1565 | 0.01 | 0.38 | 42.7 | 7.06 |
| 1-(bromodifluoromethoxy)-2-(trifluoromethyl)-1,3,3,3-tetrafluoro-1-propene | 78.6 | 6104 | 0.01 | 0.11 | 187.0 | 7.06 |
| 2-bromo-3,3,4,4,4-pentafluorobutene | 66.1 | 84 | 0.01 | 0.32 | 10.5 | 7.19 |

TABLE 1-continued

| CHEMICAL NAME | BP (C.) | GWP | ODP | T.L.T. (yrs.) | $CS/CS_{113}$ | SP $(cal/cm^3)^{1/2}$ |
|---|---|---|---|---|---|---|
| 3-bromo-2,3,4,4,4-pentafluorobutene | 69.7 | 84 | 0.01 | 0.32 | 4.9 | 7.20 |
| 4-bromo-2,3,3,4,4-pentafluorobutene | 69.2 | 84 | 0.01 | 0.32 | 6.0 | 7.21 |
| (Z)-1-(bromodifluoromethoxy)-1,2,3,3,3-pentafluoro-1-propene | 65.2 | 1334 | 0.01 | 0.14 | 70.1 | 7.22 |
| 3-bromo-3,3-difluoro-2-(trifluoromethyl)-propene | 49.7 | 733 | 0.01 | 0.32 | 15.0 | 7.24 |
| (Z)-1-bromo-1,1,4,4,4-pentafluoro-2-butene | 40.0 | 620 | 0.02 | 0.23 | 36.6 | 7.25 |
| (E)-1-(bromodifluoromethoxy)-1,2,3,3,3-pentafluoro-1-propene | 65.2 | 1334 | 0.01 | 0.14 | 70.1 | 7.25 |
| 1-(bromodifluoromethoxy)-2-(trifluoromethyl)-3,3,3-trifluoro-1-propene | 78.3 | 2729 | 0.01 | 0.08 | 151.6 | 7.26 |
| 2-bromo-1,1,2,2-tetrafluoroethoxy-trifluoroethene | 81.9 | 137 | 0.01 | 0.14 | 33.0 | 7.30 |
| (E)-1-bromo-1,1,4,4,4-pentafluoro-2-butene | 40.0 | 620 | 0.02 | 0.23 | 36.6 | 7.37 |
| 4-bromo-3,3,4,4-tetrafluoro-1-butene | 55.0 | 69 | 0.01 | 0.20 | 5.8 | 7.44 |
| (Z)-1-bromo-1,2-difluoro-2-(2,2,2-trifluoroethoxy)-ethene | 87.9 | 138 | 0.00 | 0.04 | 52.7 | 7.61 |
| (bromodifluoromethyl)-pentafluorobenzene | 153.3 | 199 | 0.00 | 0.82 | 28.2 | 7.63 |
| (Z)-1-(bromodifluoromethoxy)-2-(trifluoromethyl)ethene | 57.8 | 238 | 0.02 | 0.06 | 54.3 | 7.63 |
| 2-bromoheptafluorotoluene | 151.3 | 199 | 0.00 | 0.82 | 21.5 | 7.64 |
| (2,2,2-trifluoroethyl)(2-bromo-2,2-difluoroethyl)ether | 73.0 | 238 | 0.02 | 0.96 | 52.1 | 7.64 |
| 3-bromoheptafluorotoluene | 153.0 | 199 | 0.00 | 0.82 | 21.1 | 7.66 |
| 4-bromoheptafluorotoluene | 151.3 | 199 | 0.00 | 0.82 | 37.9 | 7.66 |
| 1-(bromodifluoromethoxy)-1-(trifluoromethyl)ethene | 66.3 | 340 | 0.01 | 0.10 | 27.7 | 7.67 |
| (E)-1-(bromodifluoromethoxy)-2-(trifluoromethyl)ethene | 57.8 | 238 | 0.02 | 0.06 | 54.3 | 7.73 |
| 1-bromo-2,4,6-tris(trifluoromethyl)benzene | 173.4 | 618 | 0.00 | 0.34 | 113.0 | 7.76 |
| 4-bromo-1,1,2,3,3-pentafluorobutene | 80.4 | 314 | 0.00 | 0.15 | 25.3 | 7.79 |
| (E)-1-(bromodifluoromethoxy)-2-(trifluoromethoxy)ethene | 76.5 | 682 | 0.02 | 0.04 | 144.9 | 7.79 |
| (Z)-1-(bromodifluoromethoxy)-2-(trifluoromethoxy)ethene | 76.5 | 682 | 0.02 | 0.04 | 144.9 | 7.79 |
| 1,1,4,4,4-pentafluoro-1-bromo-2-butanone | 89.0 | 340 | 0.01 | 0.09 | 17.1 | 7.89 |
| 1,1,5,5,5-pentafluoro-1-bromo-3-pentanone | 118.4 | 197 | 0.00 | 0.03 | 34.2 | 7.89 |
| 3-bromo-2,3,3-trifluoropropene | 41.6 | 101 | 0.02 | 0.26 | 6.1 | 7.66 |
| 3-bromo-1,3,3-trifluoropropene | 41.5 | 153 | 0.02 | 0.17 | 12.9 | 7.73 |
| 3-bromo-3,3-difluoro-1-propene | 42.0 | 66 | 0.02 | 0.13 | 5.9 | 7.89 |
| Total 44 compounds (excluding CFC-113) | | | | | | |

Table 1B

Non-bromine containing compounds in Table 1

| | | | | | | |
|---|---|---|---|---|---|---|
| 1,1,2-trichlorotrifluoroethane (CFC-113) (Comparative) | 47.6 | 5000 | 0.90 | 85 | 1.0 | 7.19 |
| (B.) 1-chloro-2,2,2-trifluoroethyl difluoromethyl ether (isoflurane) | 48.8 | 200 | 0.02 | 4.0 | 50.2 | 7.58 |
| (C.) 2-chloro-1,1,2-trifluoroethyl difluoromethyl ether (enflurane) | 56.7 | 330 | 0.02 | 5.3 | 35.5 | 7.71 |

TABLE 1-continued

| CHEMICAL NAME | BP (C.) | GWP | ODP | T.L.T. (yrs.) | $CS/CS_{113}$ | SP $(cal/cm^3)^{1/2}$ |
|---|---|---|---|---|---|---|
| (E.) methyl 2,2,2-trifluroethyl-1-(trifluoromethyl)ether | 50.8 | 28 | 0.00 | 0.18 | 107.3 | 7.26 |
| Heptafluoropropyl 1,2,2,2-tetrafluoroethyl ether | 41.0 | 597 | 0.00 | 4.5 | 195.7 | 6.62 |
| perfluorodibutyl ether | 110.1 | 33 | 0.00 | 1.2 | 896.2 | 6.65 |
| methyl perfluorobutyl ether | 51.0 | 480 | 0.00 | 3.5 | 53.5 | 6.75 |
| 3,3,3-trifluoro-bis-2,2-(trifluoromethyl)-1-propanol | 86.1 | 1201 | 0.00 | 3.5 | 40.7 | 6.81 |
| 1,2-(Z)-bis(perfluoro-n-butyl)ethylene | 132.0 | 15 | 0.00 | 0.03 | 1188.5 | 6.81 |
| 1,1,1,3,3,3-hexafluoro-2-(trifluoromethyl)-2-propanol | 46.0 | 1292 | 0.00 | 13.1 | 61.2 | 6.84 |
| 2H,3H-decafluoropentane (Vertrel XF) | 55.0 | 1300 | 0.00 | 26.8 | 91.5 | 6.84 |
| ethyl-perfluorobutyl ether | 73.0 | 70 | 0.00 | 1.14 | 69.0 | 6.85 |
| 1,1,1,5,5,5-hexafluoro-2,4-pentanedione | 69.9 | 97 | 0.00 | 0.00 | 140.5 | 6.90 |
| perfluoro-2-butyltetrahydrofuran | 103.0 | 13 | 0.00 | 2.4 | 65.4 | 6.94 |
| 1H,2H,4H-nonafluorocyclohexane | 65.0 | 252 | 0.00 | 6.19 | 18.5 | 7.02 |
| 1-methoxy-2-trifluoromethyl-1,3,3,3-tetrafluoro-1-propene | 44.5 | 933 | 0.00 | 0.07 | 154.6 | 7.09 |
| fluoromethyl 2,2,2-trifluoro-1-(trifluoromethyl)ethyl ether (SEVOFLURANE) | 59.0 | 1586 | 0.00 | 2.3 | 103.0 | 7.10 |
| (E)-2,3-dichlorohexafluoro-2-butene | 68.5 | 1104 | 0.00 | 0.32 | 72.4 | 7.15 |
| 3,3-dichloro-1,1,1,2,2-pentafluoropropane (HCFC-225) | 48.5 | 237 | 0.02 | 12.7 | 16.7 | 7.26 |
| methyl-1,1,2,2,3,3-hexafluoropropyl ether | 40.1 | 99 | 0.00 | 2.34 | 36.5 | 7.27 |
| trifluoroacetic anhydride | 40.2 | 97 | 0.00 | 0.00 | 236.9 | 7.29 |
| 2,2-difluoroethyl-1,1,2,2-tetrafluoroethyl ether | 48.4 | 152 | 0.00 | 0.92 | 114.6 | 7.31 |
| 1,3-dichloro-1,1,2,2,3-pentafluoropropane (HCFC-225cb, AK-225G) | 52.7 | 350 | 0.02 | 6.6 | 9.2 | 7.31 |
| bis(2,2,2-trifluoroethyl)ether | 62.5 | 477 | 0.00 | 1.5 | 109.2 | 7.32 |
| methyl heptafluoropropyl ketone | 63.5 | 34 | 0.00 | 0.13 | 25.4 | 7.32 |
| difluoromethyl-2,2,3,3-tetrafluoropropyl ether | 49.8 | 152 | 0.00 | 0.92 | 109.9 | 7.44 |
| bis(difluoromethoxy)-tetrafluoroethane | 58.0 | 172 | 0.00 | 0.86 | 362.3 | 7.50 |
| 2-chloro-1,1,2-trifluoroethyl ethyl ether | 88.9 | 31 | 0.00 | 0.41 | 15.0 | 7.50 |
| 1-(2,2,2-trifluoroethoxy)nonafluoro-cyclohexene | 113.7 | 112 | 0.00 | 0.05 | 70.2 | 7.51 |
| 1,2-dichloro-3,3,4,4,5,5,6,6-octafluoro-cyclohexene | 123.8 | 30 | 0.00 | 0.27 | 15.5 | 7.55 |
| ethyl-1,1,2,2-tetrafluoroethyl ether | 45.9 | 61 | 0.00 | 0.66 | 38.5 | 7.67 |
| Perfluorotoluene | 104.0 | 335 | 0.00 | 1.1 | 64.0 | 7.70 |
| methyl trifluoroacetate | 43.5 | 48 | 0.00 | 1.7 | 18.7 | 7.73 |
| methyl pentafluoropropanoate | 59.5 | 30 | 0.00 | 0.05 | 27.0 | 7.77 |
| 1,2-dichloro-hexafluoro-cyclopentene (Total 34 compounds) | 90.0 | 45 | 0.00 | 0.34 | 9.9 | 7.90 |

In general, the compounds of Table 1are halogenated acetates, alcohols, alkanes, alkenes, anhydrides, aromatics, cycloalkanes, cycloalkenes, diones, esters, ethers, heterocyclics, or ketones, with or without the heteroatom bromine. Aside from these compounds meeting the other required properties for CFC-113 replacement, the presence of bromine also has the effect of reducing flammability, although this invention does not require a bromine atom be present to reduce flammability. We have found that the compounds most useful for second-generation solvent replacements of CFC-113have the following chemical formula: $C_qH_rBr_xCl_yF_zO_p$, where q=3-10, r=0-11, x=0-1, y=0-2, z>1, and p=0-3. Many of these compounds belong to the classes of hydrofluorochloro-ethers (HFCE's), hydrobromofluorochloro-alkenes (HBFCA's), and hydrofluoro-ethers (HFE's). This formula also incorporates compounds in the families of alkanes, alcohols, diones, acetates, ketones (e.g., butanones, pentanones), esters (e.g., propanoates), anhydrides, cycloalkanes (cycloparaffins), cycloalkenes (cycloolefins), heterocyclics (e.g., furans), and aromatics. As illustrated in Table 1, all of them meet the performance requirements detailed in this invention.

Some of the ethers we have identified to be suitable solvent replacements include 1-chloro-2,2,2-trifluoroethyl difluoromethyl ether, 2-chloro-1,1,2-trifluoroethyl difluoromethyl ether, methyl 2,2,2-trifluoroethyl-1-(trifluoromethyl)ether, fluoromethyl 2,2,2-trifluoro-1-(trifluoromethyl)ethyl ether, methyl-1,1,2,2,3,3-hexafluoropropyl ether, bis(2,2,2-trifluoroethyl)ether, 2-chloro-1,1,2-trifluoroethyl ethyl ether, difluoromethyl-2,2,3,3-tetrafluoropropyl ether, difluoromethyl 1-chloro-2,2,2-trifluoroethyl ether, (2,2,2-trifluoroethyl)(2-bromo-2,2-difluoroethyl)ether, and ethyl-1,1,2,2-tetrafluoroethyl ether.

Using the further restriction of cost and availability on the compounds, we identified in Table 1, some of the preferred compounds of this invention that are viable CFC-113replacements, including:

A. 4-bromo-3-chloro-3,4,4-trifluoro-1-butene ($CH_2$═CH—CFCl—$CF_2$Br), CAS registry number 374-25-4;

B. 1-chloro-2,2,2trifluoroethyl difluoromethyl ether ($CHF_2$—O—CHCl—$CF_3$), CAS registry number 26675-46-7, C. 2-chloro-1,1,2-trifluoroethyl difluoromethyl ether ($CHClF-CF_2—O—CHF_2$), CAS registry number 13838-16-9, D. 1-bromo-2-(trifluoromethyl)-3,3,3-trifluoropropene ($CHBr=C(CF_3)_2$), CAS registry number 328-15-0, and E. methyl 2,2,2-trifluoroethyl-1-(trifluoromethyl)ether ($CH_3—O—CH(CF_3)_2$), CAS registry number 13171-18-1.

Compound B above is also known as isoflurane, and compound C is known as enflurane, both common anesthetics. These preferred compounds of our invention for CFC-113replacements have boiling points greater than about 40° C., solubility parameters within about 10% of CFC-113, ODP values less than about 0.02, lower TLT and GWP than CFC-113, and minimal toxicity lower than that of CFC-113. Of particular utility in this invention are HFCE's, previously overlooked by those skilled in the art, when combined with other halogenated ethers and/or halogenated alkenes. The use of anesthetics compounds also has advantages in that they have been thoroughly tested for toxicity by the medical community, and these compounds will be more easily and more quickly accepted as alternative solvents.

Note that the ODP for CFC-113is much higher than 0.02, classifying it as a Class II Ozone Depleting Substance. The GWP and TLT of CFC-113are also 5000 and 0.9, respectively. The toxicity of CFC-113is also typically higher than those compounds shown in Table 1. Some of the compounds identified by this approach and listed in Table 1have many properties improved over CFC-113while having the same or similar solvency properties, (e.g., solubility parameter within 10% of CFC-113).

We then proceeded to verify the primary performance properties (e.g., solvency toward different contaminants such as oils and greases) of the compounds specified by this invention. The solvency properties of the compounds taught by this invention have been verified for compounds typically found in applications, such as oxygen handling systems and refrigeration system flushing. For example, certain oils, greases and cleaners such as Mil-spec 83232hydraulic oil, Mil-spec 7808engine oil, Mil-spec 81322hydrocarbon grease, Krytox, and Simple Green are used in oxygen handling systems. The compounds listed above have been found to dissolve some of these contaminants, and when used in mixtures a broader range of contaminant types can be dissolved.

We then discovered that although some of these replacements identified and listed in Table 1can meet or exceed some of the performance properties of CFC-113, the solvency toward a variety of greases and contaminants was inferior to CFC-113 and other single component second generation compounds. Further, we discovered that by combining 2or more of these identified compounds, solvent blends can be tailored to provide optimized solvency toward a range of contaminant types. In fact, the combination of 2or more solvents can provide improved solvency toward contaminants such as greases and oils since the solvency range can be extended or broadened when compared to a single compound. This also suggests that synergies exist when combining compounds identified in this invention would not have been expected if considering only the individual components of the mixture It must also be recognized that the solvency of the 2or more compounds comprising the solvent must be similar, otherwise the 2or more components will not be soluble in each other.

The advantage of using mixtures which increase the solubility range of the solvent replacement can be appreciated when considering the solubility parameters. The solubility parameter of CFC-113is 7.2. The solubility parameter necessary to dissolve both fluorocarbon and hydrocarbon grease in oxygen systems has been found to be somewhere between 7.5and 7.7In general, values less than 7.5favors dissolution of fluorocarbon but not hydrocarbon greases whereas values in excess of 7.7tend to favor the opposite. Hence, the advantages to using the approach taught by this invention provides for improved and more versatile solvents that can not only dissolve a wide range of contaminant types, but they also meet the many other requirements placed on solvents such as environmental persistence, toxicity, and material compatibility. For example, by combining the two compounds, (A.) 4-bromo-3-chloro-3,4,4-trifluoro-1-butene and (B.) 1-chloro-2,2,2-trifluoroethyl difluoromethyl ether (aka isoflurane), the solubility parameter will still be between the values 7.65and 7.7and is shown to effectively dissolve both types of grease contaminants in an oxygen handling system.

We then proceeded to characterize other properties such as compatibility, flash point, and autogenous ignition temperature. We discovered that, contrary to commonly held beliefs, it is not necessary for the compound or the mixture to contain bromine heteroatoms in order to possess desirable flammability properties. In fact, some of the tested compounds exhibited AIT temperatures categorized as "C", or recommended for oxygen systems. We have also discovered that several of the compounds we have identified using the methods taught by this invention also have no flashpoints up to the boiling point of the compound.

This invention also teaches that a bromine-containing compound is not necessary for the mixtures of this invention to limit or eliminate flammability, but rather, these bromine containing compounds were identified by the mere virtue of their solubility parameter and other properties that have made them suitable in mixtures as replacements for CFC-113.

In using the methods taught by this invention, we have also discovered that a particularly preferred solvent replacements for CFC-113based on solvency, ODP, boiling point, and toxicity, are those with 1bromine atom. Compounds with multiple Br atoms were considered by the methods taught in this invention, but these compounds could not meet most of the required performance properties. Hence, we conclude that compounds containing more than one bromine atom will most likely be unsuitable as CFC-113replacements.

We have also discovered that many of the compounds identified have similar or better $LD_{50}$, mutagenicity and genotoxicity relative to CFC-113. Hence, combinations of these compounds will likewise have similar or better toxicity profiles. For example, the compounds 4-bromo-3-chloro-3,4,4-trifluoro-1-butene, 1-chloro-2,2,2trifluoroethyl difluoromethyl ether, 2-chloro-1,1,2-trifluoroethyl difluoromethyl ether, and methyl 2,2,2-trifluoroethyl-1-(trifluoromethyl) ether have $LD_{50}$values of >40g/kg, 8.1g/kg, 13g/kg, and >40g/kg, respectively, compared to CFC-113which has a value of 43g/kg, all values being in a range considered to be a relatively low toxicity. These same compounds also have been found to be negative for the Ames mutagenicity assay, and not genotoxic using in vitro Chinese hamster oocytes. CFC-113also is reported negative for the Ames test. Skin irritation is also an important consideration for a solvent. The compounds 4-bromo-3-chloro-3,4,4-trifluoro-1-butene, 1-chloro-2,2,2trifluoroethyl difluoromethyl ether, 2-chloro-1,1,2-trifluoroethyl difluoromethyl ether, and methyl 2,2,2-trifluoroethyl-1-(trifluoromethyl)ether have been tested and determined to be a moderate to non-irritants, whereas CFC-113is listed as a mild irritant. Hence, this invention offers improvement in some categories of toxicity compared to CFC-113. Some of the ether compounds of this invention are also used as anesthetics or anesthetic intermediates, and consequently, have undergone a considerable amount of toxicity testing by the medical community.

Solvents used in oxygen handling systems, more particularly liquid oxygen system, must not pose any risks caused by mechanical impact. We have found that many of the compounds taught by this invention can be combined to produce a mixture that is liquid oxygen-compatible solvent even when the individual components may not be compatible. For example, the compound (A) 4-bromo-3-chloro-3,4,4-trifluoro-1-butene does not pass ASTM G86for ignition sensitivity to mechanical impact in liquid oxygen, but when combined with the compound (B) 1-chloro-2,2,2-trifluoroethyl difluoromethyl ether at 25% to 50% 4--bromo -3-chloro-3,4,4-trifluoro-1-butene, the mixture passes the impact test. This result and the observed synergy were unexpected.

Furthermore, many of the compounds taught by this invention and found to posses superior solvency properties have previously been used as anesthetics or are intermediates to producing anesthetics. These compounds have been extensively tested for toxicity and mutagenicity and pose minimal risk with regard to health. Examples of these halogenated ether compounds include, but are not limited to, isoflurane, enflurane, desflurane, sevoflurane, and methoxyflurane. We have also found that the anesthetics, isoflurane (1-chloro-2,2,2-difluoroethyl difluoromethyl ether), enflurane (2-chloro-1,1,2-trifluoroethyl difluoromethyl ether), sevoflurane (fluoromethyl 2,2,2-trifluoro-1-(trifluoromethyl)ethyl ether), and methyl 2,2,2-trifluoroethyl-1-trifluoromethyl ether, an intermediate in the production of sevoflurane, have additional advantages with respect to solvency and boiling point. These compounds have not been previously considered as solvents in combination with other compounds.

Furthermore, we have discovered that many of the compounds which exhibited the best cleaning performance were compounds having a linear structure with a non-polar portion of the molecule on one end and a high electron density on the other, or having a highly branched structure, or having a very asymmetric structure. This feature could result from either branching on one end or large halogen molecules on one end. Example compounds with these characteristics are 4-bromo-3,3,4,4-tetrafluoro-1-butene, 4-bromo-3-chloro-3,4,4-trifluoro-1-butene, and methyl 2,2,2-trifluoroethyl-1-(trifluoromethyl)ether. Many of the other compounds listed in Table 1, for example, exhibit these features.

One preferred embodiment of this invention are solvents blends comprised of 4-bromo-3-chloro-3,4,4-trifluoro-1-butene and 1-chloro-2,2,2-difluoroethyl difluoromethyl ether, where the weight percentage of 4-bromo-3-chloro-3,4,4-trifluoro-1-butene in the mixture varies between about 5wt. % and about 75wt. %. We have found that combinations of these 2solvents provide exceptional cleaning performance in several applications including oxygen handling systems cleaning, and refrigeration system flushing.

EXAMPLES

Example 1

A sample comprising 25volume percent (A.) 4-bromo-3-chloro-3,4,4-trifluoro-1-butene and 75volume percent (B.) 1-chloro-2,2,2-trifluoroethyl difluoromethyl ether was added to several beakers, each containing a metal coupon completely coated with one of the following materials: Mil Spec 83282hydraulic oil, Mil Spec 7808engine oil, Krytox fluorocarbon grease and Mil Spec 81322aviation grease. Two batches were subjected to 15minute immersion with 15mL of solvent mixture but one was exposed to ultrasonic vibrations and the other kept static. Afterwards, the coupons were removed and weighed for gravimetric analysis. Results presented as percent (%) contaminant removed are shown in Table 2 below.

TABLE 2

| | 25% A + 75% B | | 100% CFC-113 | |
|---|---|---|---|---|
| Contaminant | Ultrasonic | Static | Ultrasonic | Static |
| 83282 oil | 100% | 99.2% | 100% | 100% |
| 7808 oil | 100% | 98.6% | 99.2% | 100% |
| Krytox | 94.8% | 63.7% | 97.7% | 36.2% |
| 81322 grease | 97.8% | 84.0% | 94.8% | 24.1% |

Example 2

A sample comprising 50volume percent (A.) 4-bromo-3-chloro-3,4,4-trifluoro-1-butene and 50volume percent (B.) 1-chloro-2,2,2-trifluoroethyl difluoromethyl ether was added to several beakers, each containing a metal coupon completely coated with one of the following materials: Mil Spec 83282hydraulic oil, Mil Spec 7808engine oil, Krytox fluorocarbon grease and Mil Spec 81322aviation grease. Two batches were subjected to 15minute immersion with 15. mL of solvent mixture but one was exposed to ultrasonic vibrations and the other kept static. Afterwards, the coupons were removed and weighed for gravimetric analysis. Results presented as percent (%) contaminant removed are shown in Table 3below.

TABLE 3

| | 50% A + 50% B | | 100% CFC-113 | |
|---|---|---|---|---|
| Contaminant | Ultrasonic | Static | Ultrasonic | Static |
| 83282 oil | 99.5% | 99.2% | 100% | 100% |
| 7808 oil | 97.8% | 99.6% | 99.2% | 100% |
| Krytox | 99.3% | 62.3% | 97.7% | 36.2% |
| 81322 grease | 98.6% | 95.9% | 94.8% | 24.1% |

Example 3

A sample comprising 75volume percent (A.) 4-bromo-3-chloro-3,4,4-trifluorobutene and 25volume percent (B.) 1-chloro-2,2,2trifluoroethyl difluoromethyl ether was added to several beakers, each containing a metal coupon completely coated with one of the following materials: Mil Spec 83282hydraulic oil, Mil Spec 7808engine oil, Krytox fluorocarbon grease and Mil Spec 81322aviation grease. Two batches were subjected to 15minute immersion with 15mL of solvent mixture but one was exposed to ultrasonic vibrations and the other kept static. Afterwards, the coupons were removed and weighed for gravimetric analysis. Results presented as percent (%) contaminant removed are shown in Table 4

TABLE 4

| | 75% A + 25% B | | 100% CFC-113 | |
|---|---|---|---|---|
| Contaminant | Ultrasonic | Static | Ultrasonic | Static |
| 83282 oil | 99.0% | 99.8% | 100% | 100% |
| 7808 oil | 99.8% | 99.3% | 99.2% | 100% |
| Krytox | 72.0% | 13.8% | 97.7% | 36.2% |
| 81322 grease | 99.5% | 99.4% | 94.8% | 24.1% |

Example 4

Compounds having similar solubility parameter and boiling point relative to CFC-113(solubility parameter of 7.2, boiling point of 47.6° C.) were selected using QSPR's. Table 1summarizes these properties for some of the currently preferred compounds. The units for solubility parameter are $(cal/cm^3)^{1/2}$.

The compounds were also required to have ODP's of less than 0.02to be unclassified by EPA as a Class II Ozone Depleting Substance. The toxicity of the compounds as described by a 2hr or 4hr $LC_{50}$value, and cardiac sensitization was also used as a criteria for selection. A list of compounds were compiled and ranked which met these requirements. If one of these critical performance properties was not known, it was calculated or predicted using QSPR's mathematical models. A total of 30compounds were identified with a solubility parameter within 1% of CFC-113, and 106compounds were identified with solubility parameter within 5% of CFC-113, and 201compounds had solubility parameters within 10% of CFC-113. Table 2shows a list of preferred compounds meeting the solubility parameter, boiling point and ODP restrictions.

The material compatibility of the second generation solvent must also be comparable or better than that of the first generation solvent, for example CFC-113. All of the identified second generation solvents listed above had corrosion rates with aluminum 6061and stainless steel 304which were negligible (less than 0.001 mil/year). Elastomer compatibility is also critical for a second generation solvent replacement. All of the second generation solvents of the present invention caused very little change in the mass, thickness, or diameter of PTFE. The solvents containing no chlorine or bromine had little effect on Buna-N, while the solvents containing chlorine and/or bromine had a more severe effect on Buna-N. Viton and Neoprene were significantly affected by CFC-113and 4-bromo-3-chloro-3,4,4-tribromo-1-butene, however, the other second generation solvents only had a minor affect on Viton and Neoprene. EPDM-60was significantly affected by all of the solvents tested, with significant increases in mass, diameter.

In addition to the solubility parameter, several second generation solvents were experimentally evaluated for solvency with contaminants specific to oxygen handling systems. These contaminants were Krytox and Jet Lube. The solvent $CH_2{=}CH{-}CF_2{-}CF_2Br$ (4-bromo-3,3,4,4-tetrafluoro-1-butene), had solvency performance similar to CFC-113with both contaminants. Five solvent candidates, $CH_3{-}CH_2{-}O{-}(CF_2)_3{-}CF_3$, $CHF_2{-}O{-}CHCl{-}CF_3$, $CHClF{-}CF_2{-}O{-}CHF_2CF_3{-}(CF_2)_2{-}O{-}CHF{-}CF_3$, and $CH_3{-}O{-}(CF_2)_3{-}CF_3$, had solvency performance as good or better than CFC-113with Krytox, but had poor performance with Jet Lube. Conversely, one solvent candidate, $CH_2{=}CH{-}CFCl{-}CF_2Br$, had solvency performance similar to CFC-113 with Jet Lube, but had poor performance with Krytox.

Example 5

Mineral oil is used in R-22refrigeration systems. To clean these systems, a flushing solvent must be capable of quickly dissolving residual mineral oil and other contaminants or decomposition products that form during compressor failure. Solvent mixtures comprising (1) 50wt. % A plus 50wt. % B, (2) 75wt. % A plus 25 wt. % B, and (3) 33.3wt. % A plus 33.3wt. % B plus 33.3wt. % C were produced, where (A.) is 4-bromo-3-chloro-3,4,4-tribromo-1-butene, (B.) is 1-chloro-2,2,2-trifluoroethyl difluoromethyl ether, (C.) is 2-chloro-1,1,2-trifluoroethyl difluoromethyl ether, and (E.) is methyl 2,2,2-trifluoroethyl-1-(trifluoromethyl)ether. The mineral oil was heated in a vessel with R-22using a torch to decompose it and form byproducts and residue which would be formed during a compressor burnout. This burnout oil was then applied to several metal coupons. The three solvent mixtures above were then added to separate beakers each containing one of the coupons. The coupons were subjected to 15minute immersion with 15mL of solvent mixture under static conditions at ambient temperature. Afterwards, the coupons were removed and weighed for gravimetric analysis. We found that 100%, 98.6%, and 99.3% of the compressor burnout oil was removed by solvent mixtures 1, 2, and 3, respectively.

Example 6

Alkylbenzene oil is also used in R-22refrigeration systems. To clean these systems, a flushing solvent must be capable of quickly dissolving residual alkyl benzene oil and other contaminants or decomposition products that form during compressor failure. Solvent mixtures comprising (1) 50wt. % B plus 50wt. % D, and (2) 25wt. % A plus 75wt. % C were produced, where (A.) is 4-bromo-3-chloro-3,4,4-tribromo-1-butene, (B.) is 1-chloro-2,2,2-trifluoroethyl difluoromethyl ether, (C.) is 2-chloro-1,1,2-trifluoroethyl difluoromethyl ether, and (D.) is 1-bromo-2-(trifluoromethyl)-3,3,3-trifluoropropene. The alkylbenzene oil was heated in a vessel with R-22using a torch to decompose it and form byproducts and residue which would be formed during a compressor burnout. This burnout oil was then applied to several metal coupons. The two solvent mixtures above were then added to separate beakers each containing one of the coupons. The coupons were subjected to 15minute immersion with 15mL of solvent mixture under static conditions at ambient temperature. Afterwards, the coupons were removed and weighed for gravimetric analysis. We found that 99.4% and 99.2% of the compressor burnout oil was removed by solvent mixtures 1, and 2, respectively. Table 5below summarizes the cleaning performance for the mixtures of Examples 5and 6

TABLE 5

| Example | Mixture number | Compound A, wt. % | Compound B, wt. % | Compound C, wt. % | Compound D, wt. % | % Removal of Residue, 15 min |
|---|---|---|---|---|---|---|
| 5 | 1 | 50% | 50% | | | 100.0% |
| 5 | 2 | 75% | 25% | | | 98.6% |
| 5 | 3 | 33% | 33% | 33% | | 99.3% |
| 6 | 1 | | 50% | | 50% | 99.4% |
| 6 | 2 | 25% | | 75% | | 99.2% |

Example 7

As described in Example 5, several mixtures of solvents were prepared and tested with residual mineral oil and other contaminants or decomposition products that form during compressor failure. Solvent mixtures comprising 1wt. % A, 89 wt. % B, and 10wt. % E, where (A.) is 4-bromo-3-chloro-3,4,4–trifluoro -1-butene, (B.) is 1-chloro-2,2,2trifluoroethyl difluoromethyl ether, and (E.) is methyl 2,2,2-trifluoroethyl-1-(trifluoromethyl)ether. The solvent mixture was then added to beakers containing a metal coupons. The coupon was subjected to a 15minute immersion with 15mL of solvent mixture under static conditions at ambient temperature. Afterwards, the coupon was removed and weighed for gravimetric analysis. We found that 88% of the compressor burnout oil contaminant was removed.

Example 8

Combinations of 4solvents ((A.) 4-bromo-3-chloro-3,4,4-trifluoro-1-butene, (B.) 1-chloro-2,2,2trifluoroethyl difluoromethyl ether, (C.) 2-chloro-1,1,2-trifluoroethyl difluoromethyl ether, and (E.) methyl 2,2,2-trifluoroethyl-1-(trifluoromethyl)ether) were tested for mineral oil burned in the presence of R-22. Solvents A, B, C, and E were varied in composition between 0-6wt. %, 80-95wt. %, 0-10wt. %, and 0-5wt. %, respectively. The solubility of these solvent mixtures was measured when contacting the oil and residue for 1, 5, and 10minutes with the burned mineral oil contaminant. A composition of 13.6wt. % A and 86.4% B was found to remove 98.8% of the residue in 1minute, and performed better than the other combinations for this particular residue. Results for different combinations are shown in Table 6below.

TABLE 6

| COMPOUND A, wt. % | COMPOUND B, wt. % | COMPOUND C, wt. % | COMPOUND E, wt. % | REMOVAL OF RESIDUE (10 min) |
|---|---|---|---|---|
| 6% | 79% | 10% | 5% | 95.5% |
| | 90% | 10% | | 97.5% |
| 6% | 94% | | | 96.7% |
| | 95% | | 5% | 94.4% |

Example 9

The autogenous ignition ("autoignition") temperature was measured using ASTM method G72on several compounds selected using the method of this invention. For compounds (A.) 4-bromo-3-chloro-3,4,4-trifluoro-1-butene ($CH_2{=}CH{-}CFCl{-}CF_2Br$), (B.) 1-chloro-2,2,2trifluoroethyl difluoromethyl ether ($CHF_2{-}O{-}CHCl{-}CF_3$), (C.) 2-chloro-1,1,2-trifluoroethyl difluoromethyl ether ($CHClF{-}CF_2{-}O{-}CHF_2$), (D.) 1-bromo-2-(trifluoromethyl)-3,3,3-trifluoropropene ($CHBr{=}C(CF_3)_2$), and (E.) methyl 2,2,2-trifluoroethyl-1-(trifluoromethyl)ether ($CH_3{-}O{-}CH(CF_3)_2$), the AIT's were all categorized as B or C, with compounds categorized as B being marginally category C.

Example 10

The flash point temperature was measured using ASTM method D-93on several compounds and mixtures selected using the method of this invention. For compounds (A.) 4-bromo-3-chloro-3,4,4-trifluoro-1-butene ($CH_2{=}CH{-}CFCl{-}CF_2Br$), (B.) 1-chloro-2,2,2trifluoroethyl difluoromethyl ether ($CHF_2{-}O{-}CHCl{-}CF_3$), (C.) 2-chloro-1,1,2-trifluoroethyl difluoromethyl ether ($CHClF{-}CF_2{-}O{-}CHF_2$), (D.) 1-bromo-2-(trifluoromethyl)-3,3,3-trifluoropropene ($CHBr{=}C(CF_3)_2$), and (E.) methyl 2,2,2-trifluoroethyl-1-(trifluoromethyl)ether ($CH_3{-}O{-}CH(CF_3)_2$), no flash point was observed up to their respective boiling points.

Flashpoints for mixtures of 4-bromo-3-chloro-3,4,4-trifluorobutene and 1-chloro 2,2,2trifluoroethyl difluoromethyl ether were also measured where the concentrations of the components were 25-75% 4-bromo-3-chloro-3,4,4-trifluorobutene. No flashpoints were measured.

Example 11

Solvency tests with 50% by volume 4-bromo-3-chloro-3,4,4-trifluorobutene and 50% by volume ethyl nonafluorobutyl ether were performed. The solvency characteristics of these mixtures matched or exceeded that of CFC-113with Krytox and Jet Lube. The solvency of the individual components was inferior to that of CFC-113toward Krytox and Jet Lube, illustrating the effectiveness of using mixtures as taught by this invention. Similarly, mixtures of 4-bromo-3,3,4,4-trifluorobutene and methyl nonafluorobutyl ether produced solvency characteristic that met or exceeded those of CFC-113.

Example 12

The compound ethyl perfluorobutyl ether (solubility parameter of 6.69) has been measured to provide excellent solvency toward Krytox, and the compound 1-chloro-2,2,2-trifluoroethyl difluoromethyl ether (solubility parameter of 7.61) provides solvency of Mil-spec 83232hydraulic fluid, Mil-spec 7808engine oil, and Mil-spec 81322aviation grease. Mixtures of these ethers with about 25-75% by volume ethyl perfluorobutyl ether will provide solvency of a broad range of contaminants, improved over that of CFC-113, since CFC-113is not a good solvent for Krytox, or Mil-spec 81322aviation grease.

Example 13

The compound methyl perfluorobutyl ether (solubility parameter of 6.75) has been measured to provide excellent solvency toward Krytox, and the compound 2-chloro-1,1,2-trifluoroethyl difluoromethyl ether (solubility parameter of 7.71) provides solvency of Mil-spec 83232hydraulic fluid and Mil-spec 7808engine oil. Mixtures of these ethers with about 25-75% by volume methyl perfluorobutyl ether will provide solvency of a broad range of contaminants, improved over that of CFC-113, since CFC-113is not a good solvent for Krytox.

Example 14

The compound 4-bromo-3-chloro-3,4,4-trifluoro-1-butene (solubility parameter of 7.757) has been measured to provide excellent solvency toward Mil-spec 83232hydraulic fluid, Mil-spec 7808engine oil, Mil-spec 81322aviation grease, and Simple Green aqueous cleaner, and the compound 2-chloro-1,1,2-trifluoroethyl difluoromethyl ether (solubility parameter of 7.71) provides solvency of Krytox in an ultrasonic bath and moderate solvency of Simple Green aqueous cleaner. Mixtures of these compounds with about 25-75% by volume 4-bromo-3-chloro-3,4,4-trifluoro-1-butene will provide solvency of a broad range of contaminants, improved over that of CFC-113, since CFC-113is not a good solvent for Krytox.

Example 15

The compounds methyl 2,2,2-trifluoroethyl-1-trifluoromethyl ether, 1–chloro -2,2,2-trifluoroethyl difluoromethyl ether, 2-chloro-1,1,2-trifluoroethyl difluoromethyl ether, 25% 4-bromo-3-chloro-3,4,4-trifluoro-1-butene and 75% 1-chloro-2,2,2-trifluoroethyl difluoromethyl ether, and 50% 4-bromo-3-chloro-3,4,4-trifluoro-1-butene and 50% 1-chloro-2,2,2-trifluoroethyl difluoromethyl ether were subject to ignition sensitivity to mechanical impact in liquid oxygen per ASTM G86. These compounds passed this compatibility test. The compound 4-bromo-3-chloro-3,4,4-trifluoro-1-butene alone did not pass the test. This example illustrates the unexpected benefits of using an ether such as 1-chloro-2,2,2-trifluoroethyl difluoromethyl ether in mixtures with compounds which may not alone be a suitable solvent for oxygen handling systems.

Example 16

The compounds (A) 4-bromo-3-chloro-3,4,4-trifluoro-1-butene and (B) 1-chloro-2,2,2-trifluoroethyl difluoromethyl ether, were mixed 50:50by volume and tested to remove Krytox. The individual components, A and B, remove 17.0% and 98.7%, respectively, of this contaminant after 15min. with ultrasonic treatment. The mixture removed 99.3% of the same contaminant under the same conditions. Hence, the mixture removes more of the contaminant than either of the individual compounds.

Although the invention has been described and illustrated in detail, it is to be clearly understood that the same is by way of illustration and example, and is not to be taken by way of limitation. The spirit and scope of the present invention are to be limited only by the terms of the appended claims.

The invention claimed is:

1. A method for increasing the solubility range of a solvent used to clean or degrease oxygen handling systems, refrigeration systems, implantable prosthetic devices, electronics, or optical equipment, said method comprising the steps of:

(1) providing a first compound selected from the group consisting of fluorinated alkanes, diones, heterocyclics, cycloalkanes, anhydrides, ketones, cycloalkenes, aromatics, acetates, ethers, esters, alcohols, and alkenes; and a second compound which contains one bromine atom and is selected from the group consisting of partially fluorinated aromatics, ketones, ethers, and alkenes; and (2) mixing the first and second compound to obtain the solvent with increased solvency range.

2. The method of claim 1, wherein said first compound comprises at least one compound selected from the group consisting of 2-chloro-1,1,2-trifluoroethyl ethyl ether, 1-chloro-2,2,2-trifluoroethyl difluoromethyl ether, 2-chloro-1,1,2-trifluoroethyl difluoromethyl ether, difluoromethyl 1-chloro-2,2,2-trifluoroethyl ether, fluoromethyl 2,2,2-trifluoro-1-(trifluoromethyl)ethyl ether, methyl-1,1,2,2,3,3-hexafluoropropyl ether, bis(2,2,2-trifluoroethyl)ether, methyl 2,2,2-trifluoroethyl-1-(trifluoromethyl)ether, ethyl perfluorobutyl ether, heptafluoropropyl 1,2,2,2-tetrafluoroethyl ether, and methyl perfluorobutyl ether.

3. The method of claim 1, wherein said second compound comprises at least one compound selected for the group consisting of 4-bromo-3-chloro-3,4,4-trifluoro-1-butene, 1-bromo-2-(trifluoromethyl)-3,3,3-trifluoropropene, and 4-bromo-3,3,4,4-tetrafluoro-1-butene.

* * * * *